US005329953A

United States Patent [19]

Becher

[11] Patent Number: 5,329,953

[45] Date of Patent: Jul. 19, 1994

[54] UMBRELLA, IN PARTICULAR STAND UMBRELLA

[75] Inventor: Klaus Becher, Gummersbach, Fed. Rep. of Germany

[73] Assignee: Becher Textil-und Stahlbau, Fed. Rep. of Germany

[21] Appl. No.: 946,351

[22] PCT Filed: Feb. 25, 1992

[86] PCT No.: PCT/DE92/00155

§ 371 Date: Oct. 27, 1992

§ 102(e) Date: Oct. 27, 1992

[87] PCT Pub. No.: WO92/15218

PCT Pub. Date: Sep. 17, 1992

[30] Foreign Application Priority Data

Feb. 27, 1991 [DE] Fed. Rep. of Germany ..... 4106147

[51] Int. Cl.[5] ..... A45B 19/04

[52] U.S. Cl. ..... 135/31; 135/27; 135/26; 135/39; 135/42

[58] Field of Search ..... 135/27, 31 OR, 23, 26, 135/39, 42, 37, 38, 28

[56] References Cited

U.S. PATENT DOCUMENTS

| | | | |
|---|---|---|---|
| 1,031,868 | 7/1912 | Peterson | 135/27 |
| 1,034,846 | 6/1912 | Thomas | 135/27 |
| 1,037,060 | 8/1912 | Schonert | 135/39 |
| 1,045,976 | 12/1912 | Hildreth | 135/27 |
| 1,262,122 | 4/1918 | Sonnenthal | 135/27 |
| 1,444,017 | 2/1923 | Waschek | 135/27 |
| 1,513,655 | 10/1924 | Turner | 135/27 |
| 2,775,976 | 1/1957 | Cavanaugh et al. | |
| 2,775,977 | 1/1957 | Haupt | 135/31 |
| 4,011,881 | 3/1977 | Becher | 135/27 |
| 4,610,262 | 9/1986 | Broyer et al. | 135/31 |
| 4,685,482 | 8/1987 | Yung | |

FOREIGN PATENT DOCUMENTS

| | | |
|---|---|---|
| 0392989 | 4/1990 | European Pat. Off. |
| 2149231 | 10/1971 | Fed. Rep. of Germany |
| 8507497 | 3/1985 | Fed. Rep. of Germany |
| 8915268 | 12/1989 | Fed. Rep. of Germany |
| 701502 | 9/1930 | France |

*Primary Examiner*—Carl D. Friedman
*Assistant Examiner*—Wynn E. Wood
*Attorney, Agent, or Firm*—Diller, Ramik & Wight

[57] ABSTRACT

In the case of an umbrella, in particular a stand umbrella, sunshade, garden umbrella and the like, having a framework, a roof construction and an umbrella roof, in which the roof rods (5) are articulated on a pole part (2), which is displaceable telescopically in relation to the stand tube (1) and bears a crown (3), and displaceable along the stand tube (1) is a runner (4), on which supporting struts (6) articulated on the roof rods (5) act in a jointed manner, crown (3) and runner (4) moving oppositely upon opening and closing of the umbrella, for simpler opening of the umbrella and tensioning of the umbrella roof there is provided an auxiliary strut (8), which is jointedly arranged above the runner (4) between umbrella pole (1) and at least one roof rod (5), and the runner (4) is provided with a locking device (12), by which said runner can be arrested in its upper position and the umbrella roof can be tensioned.

6 Claims, 2 Drawing Sheets

UMBRELLA, IN PARTICULAR STAND UMBRELLA

TITLE OF THE INVENTION

The invention relates to an umbrella, in particular a stand umbrella, large sunshade, garden umbrella and the like, having a framework, a roof construction and an umbrella roof, in which the roof rods are articulated on a pole part, which is displaceable telescopically with respect to the stand tube and bears a crown, and displaceable along the stand tube is a runner, on which supporting struts articulated on the roof rods act in a jointed manner, crown and runner moving oppositely upon opening and closing of the umbrella.

Umbrellas as garden or market umbrellas of the above type are known in which the movements of the umbrella pole and of the runner take place in dependence on each other by restrained means, for example by means of a threaded spindle, the runner being connected to the umbrella pole by means of a flexible drawing element, led over a deflection roller. Furthermore, garden umbrellas or the like are known in which the movements of the crown and of the runner take place oppositely in mutual dependence. In this case, the construction is designed in such a way that, in the capability of acting oppositely, the center of gravity of the roof construction remains at least approximately at the same level, so that only forces which are so small that they can be readily applied manually have to be exerted for the opening and closing of the umbrella. Such a type of umbrella has the disadvantage that although the pushing-up of the runner can be effected by hand, the tensioning of the umbrella roof, the exertion of force for which requires a multiple of the force to be exerted for opening the umbrella, cannot. Such an umbrella is not resistant to wind and storms.

SUMMARY OF THE INVENTION

The object of the invention is to provide a stand umbrella, in particular a large sunshade, in which the opening of the umbrella and the required tensioning of the umbrella roof for resistance of the same to storms can be performed easily and in a simple way. The invention of the said type is distinguished by the fact that an auxiliary strut is jointedly arranged above the runner between umbrella pole and at least one roof rod and that the runner is provided with a locking device, by which said runner can be arrested in its upper position and the umbrella roof can be tensioned.

Such a design and configuration of the large umbrella achieves the effect that the large umbrella can be opened easily and that at the same time the possibility exists of tensioning the umbrella roof on the large umbrella in such a way that the umbrella overall is resistant to wind and storms. This is obtained by use of simple means, which likewise can be actuated by hand, without more or less complicated and expensive gear mechanisms having to be used. The large umbrella or the stand umbrella remains relatively light in weight, so that it can be transported by one person. The locking device is located on the stand umbrella approximately at chest height of the operating person, so that the device remains on the one hand well observed and on the other hand, by Virtue of the appropriate height, easily operable. The locking device itself is of a simple type and consequently inexpensive. In particular, the guarantee is provided that the umbrella roof can be tensioned extremely tautly, which is necessary in the case of an all-weather umbrella, by simple means which can be operated by hand.

For the locking device, a clamping lever closure is provided. On this there is a fixedly arranged abutment as well as a clamping element engaging together with the abutment.

The abutment is advantageously located on the stand tube. The fastening of the same expediently takes place by means of a holding arm, which is downwardly disposed. The holder arm [sic] is preferably fastened above the runner displacement path on the stand tube and is guided through a bore, a slit or the like on the runner.

Furthermore, to facilitate handling for the opening and closing operation of the umbrella, the runner is provided with an extension, which is designed as a tube and on which the clamping element of the clamping lever closure can be attached. This provides the possibility of the locking of the runner located in the upper position being able to take place approximately at chest height of the operating person.

The invention is explained below with reference to an illustrative embodiment represented in the drawing:

DESCRIPTION OF THE PREFERRED EMBODIMENTS

Figure 1:
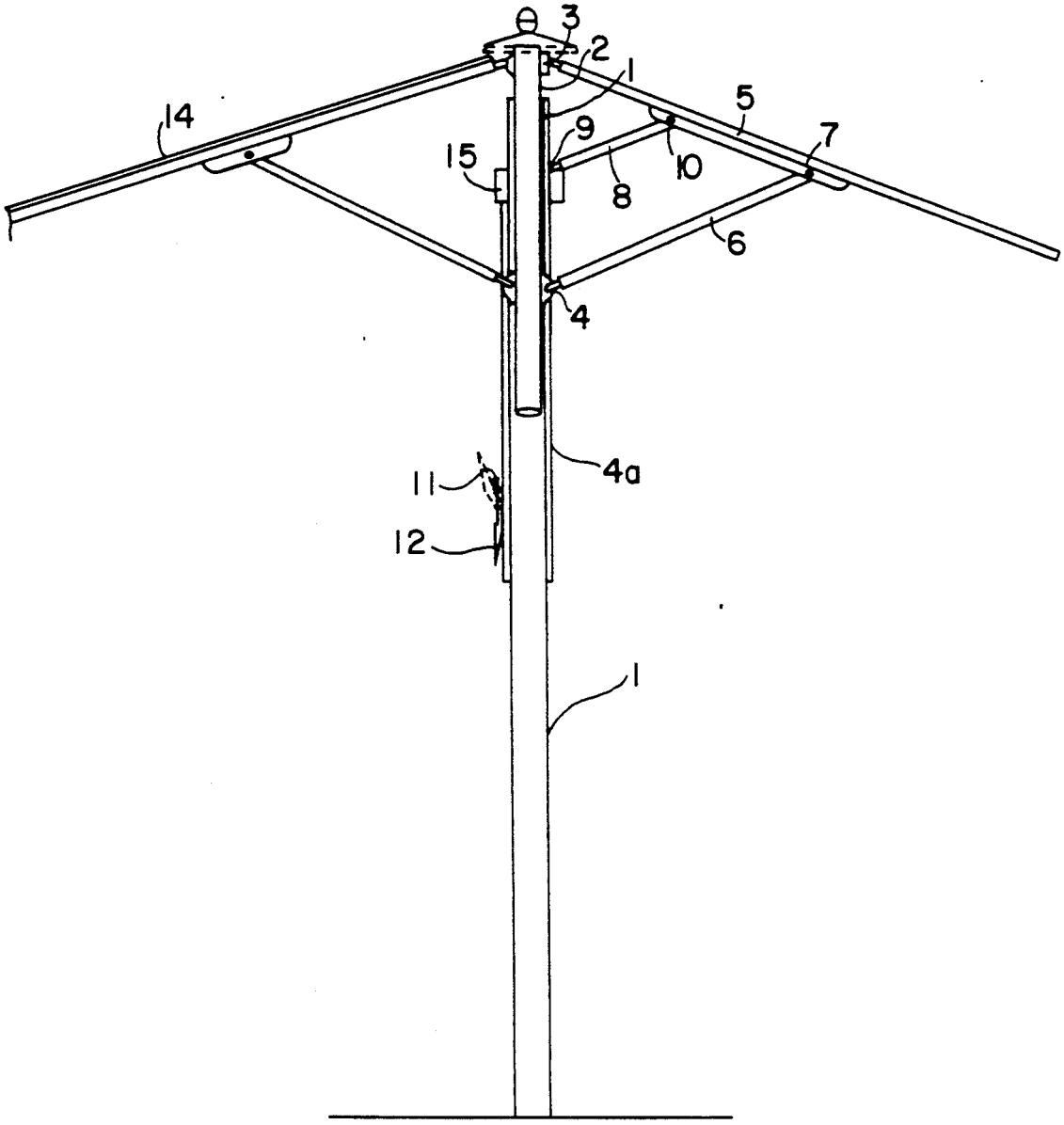
FIG. 1 shows the umbrella according to the invention in the opened position.
Figure 2:
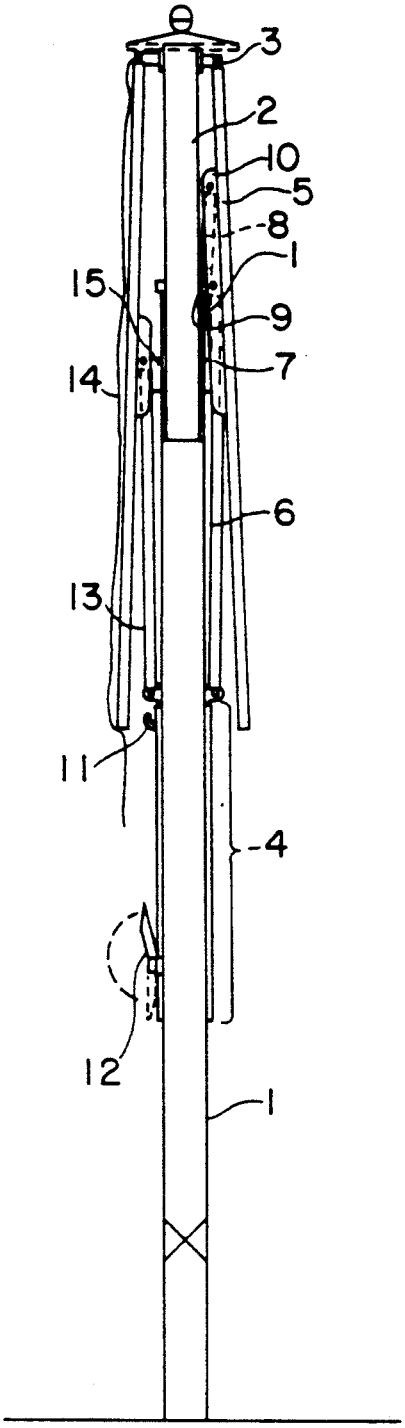
FIG. 2 represents the umbrella of FIG. 1 in the closed position.
Figure 3:
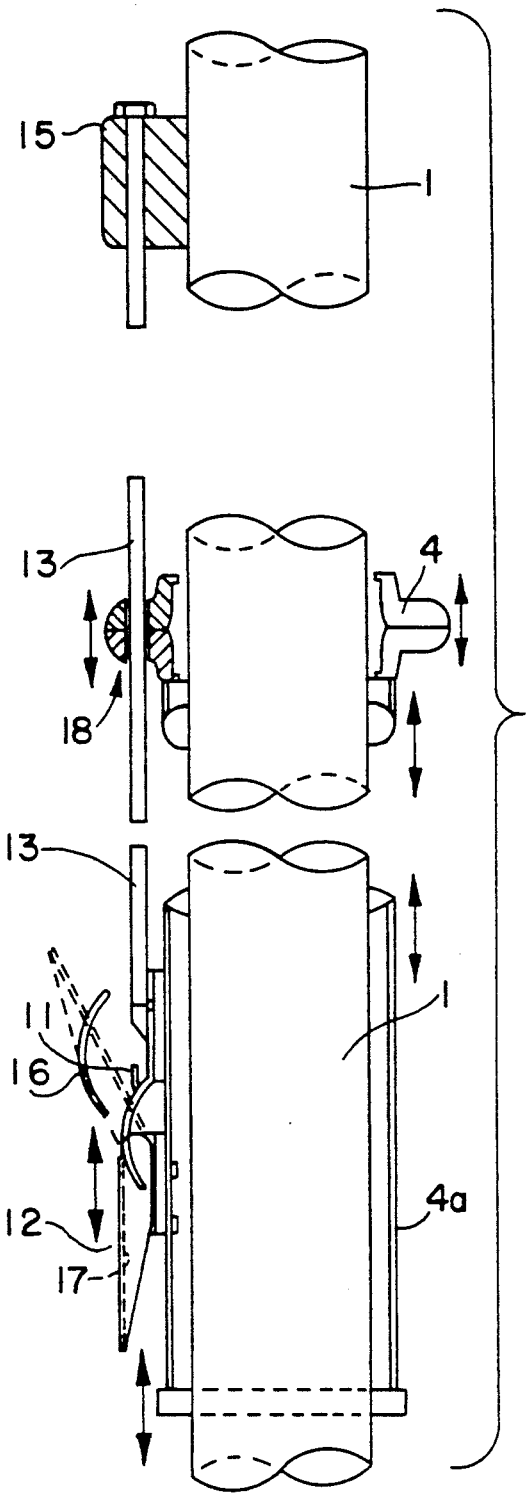
FIG. 3 illustrates a detail of the umbrella pole with locking device diagrammatically on an enlarged scale.

The umbrella of the invention has a stand tube 1, in which a pole part 2 is mounted telescopically displaceably. The pole part 2 is provided with a crown 3, on which the roof rods 5 are articulated. A runner 4 is mounted displaceably along the rigid pole part 1. Between the runner 5 and the roof rods, articulated supporting struts 6 are located on both sides. The points of articulation on the roof rods are denoted by 7.

Furthermore, there are auxiliary struts 8, to be precise all around in uniform distribution, or at least numbering two, arranged toward each other in the radial plane. The auxiliary strut is articulated on the one hand at 9 on the umbrella pole 1 and on the other hand at 10 on the roof rods.

The runner 4 is provided with a tubular extension 4*a*, which runs to the lower pole end and serves to facilitate handling for the displacement of the runner 4. The clamping lever closure 12 is located on the tubular handling extension 4*a*. Said clamping lever closure operates together with an abutment 11, which is located at the end of a rigid holder arm [sic] 13, which is fixedly attached on the umbrella pole 1 at 15, above the displacement path of the runner 4. 14 denotes the umbrella roof or the umbrella covering.

Upon closing and opening of the umbrella, the crown 3 and runner 4 forcibly move toward each other and away from each other, respectively. The forcible capability of acting oppositely of crown and runner is produced by virtue of the framework construction and the auxiliary struts 8 arranged diametrically here, which struts are fixedly articulated on the umbrella pole 1 at 9 and act on the roof rods at 10. Upon closing, the runner 4 is drawn downward by the tube extension 4*a*, whereupon the auxiliary strut 8 moves the supporting strut 6 until in the direction of the umbrella pole. As a result, the telescopic pole 2 with the crown 3 is displaced upward, which has the consequence of the roof rods coming to bear against the umbrella pole 1. With the umbrella closed, the runner 4 with the tube extension 4*a*, serving as handle, is initially pushed upward by very little exertion of force until virtually complete opening of the umbrella. As soon as and when during pushing-up of the runner 4, 4*a* the first change in resistance to the hand is perceptible (beginning of the actual roof tensioning phase), the reversible tensioning spring clip 16 of the clamping lever closure 12 can be engaged in the abutment 11, to be precise by means of the hand lever 17. Consequently, the tendency of the runner 4, 4*a* to travel down again after letting go its downwardly prolonged extension 4*a*, serving as handle, is initially stopped. After that, the actual hand lever 17 of the clamping lever closure 12 is shifted downward, overcoming a pressure point, which can be carried out by hand, for example by means of the ball of the thumb. By this shifting operation of the clamping lever 17, that force which is required to overcome the remaining lever path of the runner 4 and the associated mechanical resistance which builds up during the actual tensioning of the umbrella roof can be generated.

The expenditure of force required for tensioning the umbrella roof 14 is a multiple (depending on the size of the umbrella 10 to 30 times) of the manual force required for opening the umbrella, i.e. the raising of the runner (unfolding/spreading of the roof construction including the roof skin). This force (for the final tensioning of the umbrella roof), which cannot be applied manually, can be effortlessly generated by means of the hand lever 17 of the clamping lever closure 12 for the final tensioning of the umbrella roof.

The "remaining" opening, at the same time the final tensioning of the umbrella roof by means of the clamping lever closure 12, has in addition the purpose relieving the user of the umbrella of the decision as to whether and when the umbrella is adequately tensioned and to which extent of final opening the roof construction is to be brought, in dependence on the static tensioning force potential.

The length of the supporting struts 6 and their points of articulation 7 on the roof rods 5, as well as the length of the auxiliary struts 8 and the position of their points of articulation 10 on the roof rods 5 are to be chosen in such a way that the center of gravity of the roof construction shifts downward at least approximately so far out of the same or balanced height that the opened umbrella closes of its own accord after relieving and releasing its clamping lever closure 12. In addition, they are to be chosen in such a way that the resulting maximum vertical displacement distance of the displaceable pole part 2 is in any case shorter or less than that of the runner 4, 4*a*.

The abutment 11 is to be suspended or fastened with its vertically freely hanging carrying arm 13 by the upper end of the latter on the outer umbrella pole 1 eccentrically with respect to the vertical center axis of the umbrella pole. The length of the carrying arm 13 and the position of its upper suspension point 15 on the outer umbrella pole, as well as the overall length of the runner path 4 are to be chosen in such a way that the maximum vertical displacement path between the closed position of the clamping lever closure 12 and the abutment 11 is at least approximately equal to the maximum vertical displacement path of the runner 4 on the umbrella pole 1.

The length of the holder arm [sic] 13 and the position of its upper fastening end or suspension point on the outer umbrella pole 1 are to be chosen in such a way that, upon manual raising of the runner 4, 4*a*, the tensioning clip 16 of the clamping lever closure 12 arrives at least approximately in that spatial position in which the tensioning clip 16 of the clamping closure 12 can engage effortlessly in the abutment 11 at the lower end of the carrying arm 13 before during raising of the runner even an only marginally higher mechanical resistance is established than that during the straight-forward raising operation of the runner 4, 4*a*.

Since the abutment 11 and its holding arm 13 spatially and physically oppose the displaceability of the runner 4, the runner 4 is provided between the upper fastening 5 of the holding arm 13 on the umbrella pole and the lower abutment 11 with a bore 18 or an open longitudinal slit, which allows the free sliding of the holding arm 13 virtually free from friction with respect to the displacing of the runner 4. Instead of the specified system, it is also possible to fasten an abutment required for the clamping lever closure 12 on the outer umbrella pole 1 without a holding arm. The displaceability of the runner 4 is guaranteed by the runner 4, 4*a* having a vertical long-hole clearance over the predominant length of its tubular extension 4*a* in the outer wall of the latter. In the case of an abutment 11 attached directly on the outer umbrella pole 1, such a long-hole clearance can be dimensioned significantly smaller in vertical extent if the abutment 11 can be pressed counter to a compression spring included in its fastening against the outer umbrella pole 1 to such an extent that, by virtue of the choice of size and position of the reduced long hole or of the reduced clearance on the wall of the runner extension 4*a*, said abutment is not pressed outward by the spring force and does not become accessible for the tensioning clip of the clamping lever closure 12 until the hole clearance in the downwardly prolonged part of the runner 4 has, during displacing of the latter, reached the position of the abutment 11 pressed counter to the spring force onto or into the umbrella pole 1 and consequently allows a physical springing-out of the abutment 11 through the hole clearance.

Advantageously used is a textile roof covering which, resting on the roof rods 5, is fastened at one end in the open cross section of the profile of the roof rods and at the other end by means of hooks, a radial pretensioning means being fastened by means of a clamping closure, for example similar to the type of the clamping lever closures 12, seated on the undersides of the roof rod ends 5.

Although a preferred embodiment of the invention has been specifically illustrated and described herein, it is to be understood that minor variations may be made in the apparatus without departing from the spirit and scope of the invention, as defined the appended claims.

I claim:

1. An umbrella comprising a framework, a roof construction and an umbrella roof in which roof rods are articulated on a pole part; said pole part being displaceable telescopically in relation to a stand tube and carries a crown, a runner displaceable along the stand tube, said crown and runner being movable oppositely in mutual dependence upon each other during opening and closing of the umbrella, at least one auxiliary strut of a predetermined fixed length for forcing opposite movement of the crown and runner in mutual dependence upon each other, one end of said at least one auxiliary strut being articulated on the stand tube and the other end of said at least one auxiliary strut being articulated on at least one of the roof rods, a supporting strut articulately connected to at least one of said roof rods and said runner, and said runner being provided with a locking device by which said runner can be arrested in an upper position whereby the umbrella roof can be tensioned by said supporting strut.

2. Umbrella according to claim 1, characterized in that the locking device (12) is a clamping lever closure and in that the clamping lever closure (12) has a fixedly arranged abutment (11) and a clamping element (16, 17) engaging together with the abutment ( 11).

3. Umbrella according to claim 1 or 2, characterized in that the abutment (11) is arranged on the stand tube or the umbrella pole (1) and in that the fastening takes place by means of a holding arm (13).

4. Umbrella according to claim 1, characterized in that the runner (4) is provided with an extension (**4*a*), which is designed as a tube and projects oppositely of the framework and on which the clamping element (12**) of the clamping lever closure is attached.

5. Umbrella according to claim 1, characterized in that the holding arm (13) for the abutment (11) is fastened above the runner displacement path on the umbrella pole (1) and in that the holding arm (13) is guided through a bore (18), through an open slit or the like of the runner (4).

6. Umbrella according to claim 1, characterized in that the abutment (11) is arranged with its holding arm (13) central to the vertical center axis of the umbrella pole (1).

* * * * *

UNITED STATES PATENT AND TRADEMARK OFFICE

CERTIFICATE OF CORRECTION

PATENT NO. : 5,329,953

DATED : July 19, 1994

INVENTOR(S) : Klaus BECHER

It is certified that error appears in the above-identified patent and that said Letters Patent is hereby corrected as shown below:

In the heading:

The assignment information is incorrect and should read as follows:

[73] Assignee: Becher Textil- und Stahlbau GmbH
Fed. Rep. of Germany

Signed and Sealed this

Fifth Day of September, 1995

*Attest:*

*Attesting Officer*

BRUCE LEHMAN

*Commissioner of Patents and Trademarks*